United States Patent [19]

Ashby et al.

[11] Patent Number: 4,825,501

[45] Date of Patent: May 2, 1989

[54] VACUUM CLEANING APPARATUS

[75] Inventors: Derek Ashby, Dartford; Sajjadali G. Ali, London; Raymond H. Forward, Stevenage, all of England

[73] Assignee: Steam Vacuum Extraction Limited, London, England

[21] Appl. No.: 81,572

[22] Filed: Aug. 4, 1987

Related U.S. Application Data

[63] Continuation of Ser. No. 700,187, Feb. 11, 1985, abandoned.

[30] Foreign Application Priority Data

Feb. 16, 1987 [GB] United Kingdom ..... 8404051

[51] Int. Cl.[4] ..... A47L 7/00

[52] U.S. Cl. ..... 15/321; 15/328; 134/21

[58] Field of Search ..... 15/322, 321; 134/21

[56] References Cited

U.S. PATENT DOCUMENTS 1,042,713 10/1912 Moorhead ..... 15/322
4,137,599 2/1979 Steyer ..... 15/321
4,333,203 6/1982 Yonkers ..... 15/322
4,360,946 11/1982 Marshall, Jr. et al. ..... 15/321
4,485,518 12/1984 Kasper ..... 15/322

FOREIGN PATENT DOCUMENTS 1448423 6/1974 United Kingdom .

*Primary Examiner*—Asok Pal
*Attorney, Agent, or Firm*—Parmelee, Miller, Welsh & Kratz

[57] ABSTRACT

Also proposed is apparatus for cleaning hard and soft surfaces by simultaneous application thereto of liquid and vacuum using a tool and which is equipped with a conversion device to permit dry vacuum cleaning with entrainment of dry soil in the liquid for subsequent collection in a soil and liquid vessel. The device (FIG. 4) comprises a 2-way valve (7) by which liquid flowing through a first pipe (5) can be caused to flow alternatively to a head (1) of a tool, or, through at least one branch pipe (9) to a second pipe (6) or pipe insert (11) by which suction is applied to the head (1) of the tool to entrain the dry soil flowing therein. The branch pipe or pipes normally terminate in one or more spray nozzles and may be located at various different positions in the path of flow of the dry soil induced by vacuum.

6 Claims, 2 Drawing Sheets

VACUUM CLEANING APPARATUS

This is a continuation of co-pending application Ser. No. 700,187 filed on Feb. 11, 1985 now abandoned.

This invention relates to apparatus for the cleaning of soft and hard surfaces and of the kind which operate by the simultaneous application thereto of liquid and vacuum. Typical apparatus of this kind are described in U.S.A. Patent Specification No. 3262146 and our British Patent Specifications Nos. 1,448,434 and 1,497,709. This kind of apparatus essentially comprises a tool which is connected by a first pipe to a tank or other source of liquid supply and by a second pipe to a source of vacuum and a liquid-containing soil-collecting vessel. In operation the liquid is applied on the surface to be cleaned through a spray nozzle or nozzles located on or within the tool and is continuously withdrawn with entrained dirt under the effect of the vacuum. The liquid may be water or some liquid solution.

The invention has been devised with the object of enabling apparatus of the aforementioned kind to be used also as a dry vacuum cleaning apparatus, that is to say without application of liquid to the surface to be cleaned.

However in its widest aspect the invention consists of a method of collecting dry soil in the dry vacuum cleaning of soft and hard surfaces in which vacuum only is applied to such surface and dry soil flowing away from such surface under the influence of vacuum is sprayed with liquid and deposited in a wetted condition in a liquid and soil-collecting vessel.

More particularly in accordance with the invention there is provided apparatus of the kind referred to including a conversion device by which the liquid normally supplied can optionally be diverted to at least one spray nozzle disposed so as to spray the liquid into the vacuum induced path of flow of dry soil, e.g. dust or dirt particles, from a cleaning head of a tool so as to entrain it and deposit it in a liquid and soil-collecting vessel.

Preferably the conversion device comprises means, such as a two-way valve, by which liquid flowing through the first pipe can be caused to flow to the surface to be cleaned via a tool as aforesaid or, through a branch pipe, to the second pipe or elsewhere to entrain the dry soil flowing therein from the head of a tool to the collecting vessel.

Preferably the liquid outlet end of the branch pipe sprays through the wall of a tubular insert which is connected into the second pipe or elsewhere to entrain the dry soil as mentioned above. The invention also consists in a conversion device for fitting as aforesaid to a vacuum cleaning apparatus of the kind referred to and comprising a two-way valve, a liquid inlet pipe, a liquid outlet pipe and a liquid outlet branch pipe terminating in at least one spray nozzle. The location of the conversion device or parts relative to the tool and the apparatus may be varied as will be hereinafter, by way of example, described.

The nature and some modes of fitting of the conversion device and its manner of operation are hereinafter described by reference to the accompanying drawings.

BRIEF DESCRIPTION OF DRAWINGS

In these drawings.

Figure 1:
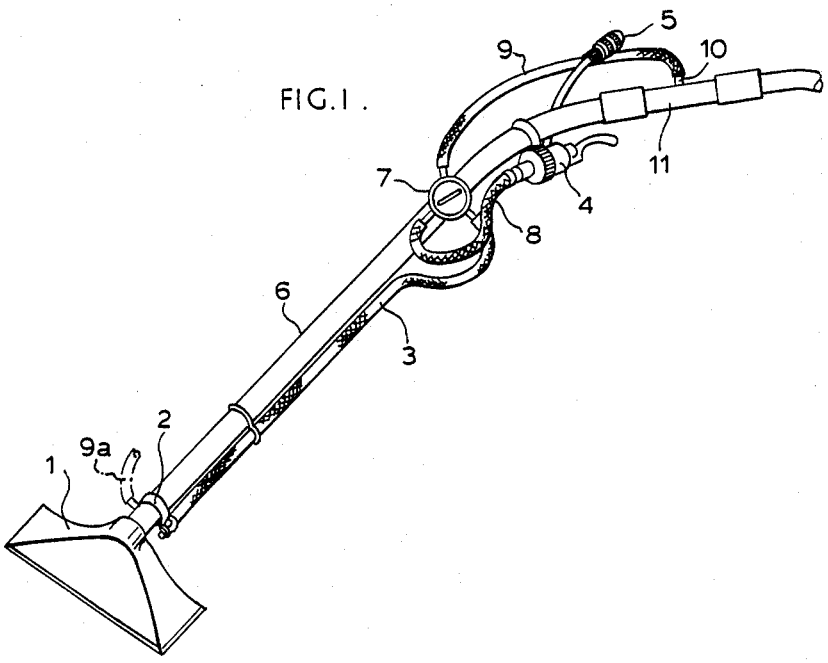
FIG. 1 is a schematic view of a typical cleaning tool.
Figure 2:
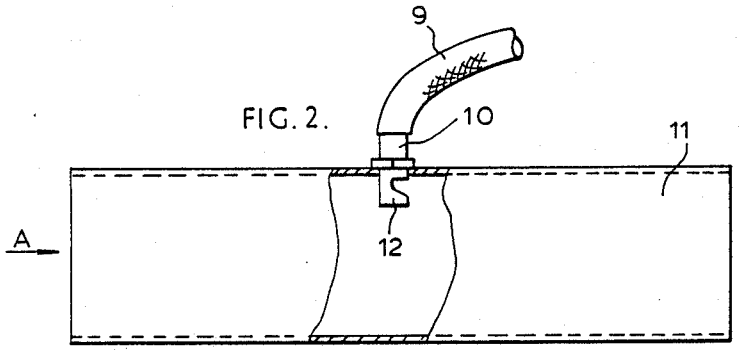
FIG. 2, on an enlarged scale, is a fragmentary view of a branch pipe connection.

Referring now to the drawings, and particularly to FIG. 1, there is shown a tool of a liquid and vacuum cleaning apparatus of the general kind disclosed in the already mentioned U.S.A. and British Patent Specifications. The tool has a head 1 connected to a source of vacuum by an elongated pipe 6. Secured by clips to the pipe 6 is a smaller diameter liquid supply pipe 3 which hitherto was connected directly through a control valve assembly 4, to the inlet pipe 5 either from a tank containing liquid or from some other source of liquid supply such as a tap. As shown however, the liquid supply pipe 3 is connected to the valve 4 by way of a conversion device comprising a two-way valve 7 and a coupling pipe 8. The two-way valve 7 is connected by a branch pipe 9 to a union 10 which extends radially through the wall of a tubular member 11 which has been inserted in the vacuum supply pipe 6. The union terminates in at least one spray nozzle 12 which for example faces in the direction of air flow as shown in FIG. 2. It could however face in any direction. The valve 7 has a handle by which it may be moved alternatively between a position in which it causes the liquid to flow along the pipe 3 to the surface to be cleaned and an alternative position in which it causes the liquid to flow along the branch pipe 9 and into the tubular insert 11 where it issues from at least one spray nozzle 12 and entrains the dry soil which, under the influence of the vacuum, is travelling through the insert 11 as indicated by the arrow A. The liquid solution with the dry soil entrained therein discharges into the usual collecting vessel.

FIG. 1 shows that the branch pipe with its spray nozzle or nozzles may terminate in an alternative position **9*a* directly behind the head 1**.

Alternatively the branch pipe and the or each spray nozzle could terminate anywhere along the pipe 6 or in a pipe connecting the latter to a source of vacuum.

Figure 3:
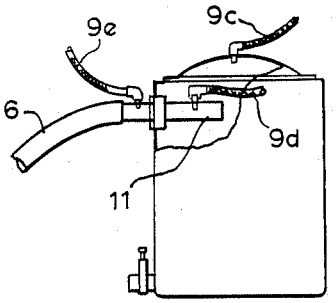
FIG. 3 shows some modes of fitting to a collecting vessel and FIG. 4 illustrates components of a conversion device.

FIG. 3 shows three further alternative positions of the branch pipe and its associated spray nozzle or nozzles. In one position (**9*c*) there is a connection through the vacuum sealing cover of a liquid and soil-collecting vessel, whilst in the other positions (9*d*) and (9*e*) there is a connection into a tubular insert 11 which is located respectively inside and outside the soil-collecting vessel. In all instances where a tubular insert 11** is used, the location of the latter between the source of vacuum and the head of a tool can be varied.

Further it is to be understood that there may be two or more branch pipes and/or two or more tubular inserts 11 connected at two or more of the alternative positions which have been mentioned above.

Figure 4:
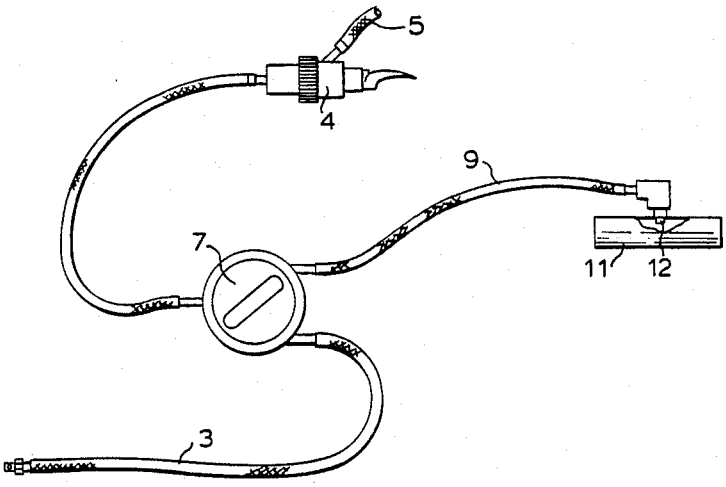

The conversion device which has been described and which may take the form of an accessory kit (FIG. 4) has been found to function most efficiently in that when the valve 7 is in the dry vacuum cleaning position the advantage of dry vacuum cleaning is obtained without the usual problems of dry soil escaping from a dry soil collecting container since the dry soil becomes suspended in or deposited with the liquid in the liquid and soil collecting vessel.

Thus the need for dry soil dust bags is eliminated as also is the need for additional filtration of the exhaust air therefrom. A single machine can thus have two distinct modes of operation However the entraining of dry soil as aforesaid can also be achieved without the use of a two way valve (7)

and branch line (9) by locating the liquid supply pipe (3) to spray liquid anywhere in the positions mentioned hereinabove.

We claim:

1. Apparatus for the dry vacuum cleaning of surfaces in which only a vacuum is applied to said surface and the wet vacuum cleaning of surfaces in which a vacuum and a cleaning liquid is applied to said surface, comprising:

a cleaning head intended to be applied to said surface;

a liquid and dirt-collecting vessel;

a liquid supply pipe connected at one end to said cleaning head and at the other end to a liquid supply source;

a source of vacuum;

a second pipe connected at one end to said cleaning head and at the other end both to said source of vacuum and to said liquid and dirt-collecting vessel and being in direct flow communication with said cleaning head when said apparatus is applying a vacuum and a cleaning liquid to said surface;

at least one spray nozzle positioned between said cleaning head and said source of vacuum in the path of flow of dry dirt along said second pipe towards said liquid and dirtcollecting vessel;

a conversion device connected to said liquid supply source, said liquid supply pipe and each said spray nozzle; and a branch pipe effecting said connection between said conversion device and each said spray nozzle and being in flow communication with said liquid supply source and each said spray nozzle when said apparatus is applying only a vacuum to said surface;

whereby said conversion device is capable of operating in a first position in which said liquid flows from said liquid supply source through said liquid supply pipe directly to said surface through said cleaning head, and a second position in which said liquid flows from said liquid supply source through said branch pipe to each said spray nozzle and through each said spray nozzle to said second pipe so that said liquid is in flow communication with and entrains dry dirt flowing under the influence of said source of vacuum in said second pipe from said cleaning head to said liquid and dirtcollecting vessel, and said entrained dirt is deposited into said liquid and dirt-collecting vessel in a wetted condition.

2. An apparatus as defined in claim 1 in which said conversion device comprises a two-way valve by which liquid supplied from said liquid supply source can be caused to flow alternatively onto the surface to be cleaned, or through said branch pipe to said at least one spray nozzle, and said at least one spray nozzle is positioned in said second pipe, whereby liquid supplied to said second pipe entrains the dry dirt therein flowing from said cleaning head to said liquid and dirt-collecting vessel.

3. An apparatus as defined in claim 1 including a tubular insert positioned between said cleaning head and said source of vacuum, and said at least one spray nozzle sprays liquid through said tubular insert into the path of dry dirt flowing under the influence of said source of vacuum from said cleaning head through said second pipe to said liquid and dirt-collecting vessel to entrain said dirt.

4. An apparatus as defined in claim 1 wherein said at least one spray nozzle is positioned in said second pipe adjacently outside said vessel.

5. An apparatus as defined in claim 1 wherein said at least one spray nozzle is positioned in said second pipe inside said vessel.

6. An apparatus as defined in claim 1 wherein said vessel has a vacuum sealing cover and said at least one spray nozzle is positioned in said cover.

* * * * *